United States Patent [19]

Coviello

[11] 4,056,020

[45] Nov. 1, 1977

[54] HAND-GRIPPABLE DRIVER-FASTENER TOOL

[76] Inventor: Joseph Coviello, 163-09 99th St., Howard Beach, N.Y. 11414

[21] Appl. No.: 716,995

[22] Filed: Aug. 24, 1976

[51] Int. Cl.[2] ..... B25B 15/00

[52] U.S. Cl. ..... 81/177 A; 81/177 G; 145/50 C

[58] Field of Search ..... 81/177 R, 177 A, 177 G, 81/71; 145/50 C, 50 A

[56] References Cited

U.S. PATENT DOCUMENTS

| | | | |
|---|---|---|---|
| 1,420,279 | 6/1922 | Parsons et al. | 81/177 A |
| 2,658,766 | 11/1953 | Rock | 145/50 C X |
| 3,356,117 | 12/1967 | Wagner | 81/177 R |

*Primary Examiner*—James L. Jones, Jr.
*Assistant Examiner*—James G. Smith

[57] ABSTRACT

A hand-held fastener tool includes a handle with a first socket in one end and a second socket in a side wall adjacent to the other end of the handle. An aperture of lesser lateral dimension than that of the second socket is formed in the handle and extends transversely therethrough to communicate with the second socket. First and second driver-fasteners are adapted to fit non-rotatably and releasably within the respective first and second sockets to extend therefrom. The tool is thus graspable at either end during the fastening operation and is capable of being rotated or applying leverage to the fastener at the other end.

6 Claims, 3 Drawing Figures

HAND-GRIPPABLE DRIVER-FASTENER TOOL

BACKGROUND OF THE INVENTION

The present invention relates to a hand-held fastening tool.

Hand-held fastening tools have long been known. The most common of such tools are the screw-driver and the box wrench. However, where the fastening element such as the screw-driver blade or the socket of the box wrench is carried by the tool at the axial end thereof it was frequently difficult to develop sufficient leverage to drive the fastening element to either secure the fastening means or to dislodge same and resort was had to the use of two different tools. Also, such tools are generally designed to accept one type of fastening element which may be a screw-driver blade or socket wrench. It is often desirable to have a tool which is capable of accepting two or more of such fastening elements such as a screw-driver adapted to function cooperably with both Phillips head screws and the straight slatted screws. It is also inconvenient to have a tool which is operable only from one end since there are times when because of space requirements it would be handy to have a tool in which the fastening element can be secured at a different location of the tool. There does not appear to be any such hand tool presently available. U. S. Pat. No. 1,743,505 issued Jan. 14, 1930 discloses a hand-held tool capable of accepting both screw-driver blades and wrench sockets, and of increasing the torque at the operative end of the tool; however, the fastening element may only be secured at one end of the tool and, therefore, does not afford the total versatility described above for combined leverage and rotation.

SUMMARY OF THE INVENTION

It is one object of the invention to provide a hand-held fastening tool specially constructed to accommodate more than one fastening element thereon and at more than one location of the tool.

It is another object of the invention to provide a hand-held fastening tool so constructed as to be able to accommodate a drive-fastening element adjacent either end of the tool such that the tool can be grasped at either end to apply leverage or rotation to the fastening element at the other end.

It is still another object of the invention to provide a hand-held fastening tool capable of accommodating at least one driver-fastening element so as to extend in mutually perpendicular directions so as to permit the tool to be employed in situations where different spatial clearances exist.

Other objects and advantages of the invention will become readily apparent from the following description of the invention.

According to the present invention there is provided a hand-held fastening tool comprising in combination:

and axially elongated handle;

a first socket formed in an end thereof adapted to receive and non-rotatably retain a first fastener therein;

a second socket formed in a side wall of the handle adjacent to the other end thereof and extending transversely thereinto adapted to receive and non-rotatably retain a second fastener therein;

an aperture of lesser lateral dimension than said second socket being formed in said handle adjacent said other end extending transversely thereinto and communicating with said second socket;

and first and second driver-fasteners adapted to fit respectively within said first and second sockets to be nonrotatably and releasably held therein;

whereby said tool may be grasped at either of the ends thereof during the fastening operation and leverage or rotation applied to the driver-fastener at the other end.

BRIEF DESCRIPTION OF THE DRAWINGS

In order that the invention may be more fully understood it will now be described, by way of example, with reference to the accompanying drawings, in which.

DETAILED DESCRIPTION OF THE INVENTION

Figure 3:
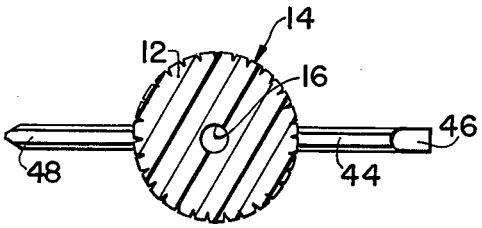
FIG. 3 is an elevational cross-sectional view of the tool shown in FIG. 1 taken along line 3—3 thereof.

Referring to the drawings there is shown a hand-grippable fastening tool identified generally by reference numberal 10. The tool comprises a handle 12 which as can be seen most clearly from FIG. 3, may be of cylindrical configuration and provided on its outer surface with knurls or longitudinal ridges 14 to facilitate gripping of the tool. A centrally located opening 16 may be formed in the handle so as to reduce the weight of the tool and require the use of less material which would reduce the cost of the tool. It will be understood, of course, that if desired the handle need not be provided with opening 16, and, except for the provision of the sockets 18, 20 and transverse aperture 30, may otherwise be solid throughout.

The handle is provided in one of its end walls with a first socket 18. The face of the end wall is desirably countersunk to receive a metal insert 24 adapted to serve as a seat for the tang of driver-fastener member to be described shortly. It will be understood, of course, that the metal insert can be formed integrally with the handle such as at the time the handle is moulded. The socket may be given any of a number of crosssectional configurations such as square, hexagonal, octogonal and the like. The insert, of course, is given a complementary shape.

Figure 2:
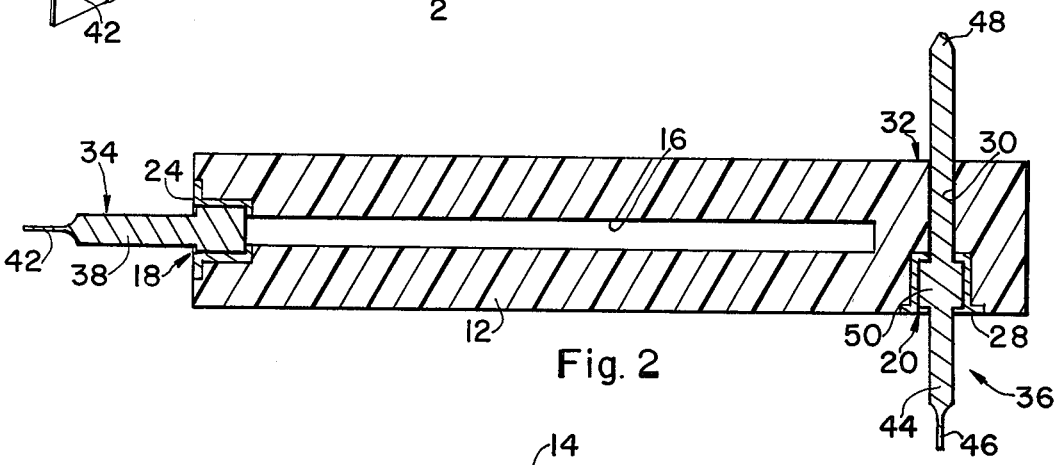
FIG. 2 is a longitudinal cross-sectional view of the tool and fastening elements shown in FIG. 1 taken along line 2—2 thereof.

A second socket 20 is formed adjacent to the other end of the handle and extends through the side wall 26 transversely into the handle. As with socket 18 the side wall of the handle is desirably countersunk to accept a metal insert 28 which is intended to serve as a seat for the tang of a second driverfastener member to be described. Metal insert 28 can likewise be formed integrally with the handle at the time of moulding if the handle is made in such manner. Socket 20 and its insert 28 may be given the same cross-sectional configuation as that of socket 18 and insert 24. However, it is not essential that the configurations be identical. The provision of identical configurations does enable the interchangeability of the driver-fasteners and hence is preferred. In such event the opening 16 should be of sufficient lateral dimension and of sufficient depth to accept driver-fastener 36. An aperture 30 of lesser lateral dimension than that of the socket 20 is formed in the handle and extends from the apposed side wall 32 transversely into the handle to communicate with the center of socket 20. FIG. 2 illustrates this construction most clearly.

The tool is provided with a pair of driver-fastener attachments 34, 36 which are adapted respectively to fit within the respective sockets 18, 20 to be non-rotatably and releasably held therein.

Figure 1:
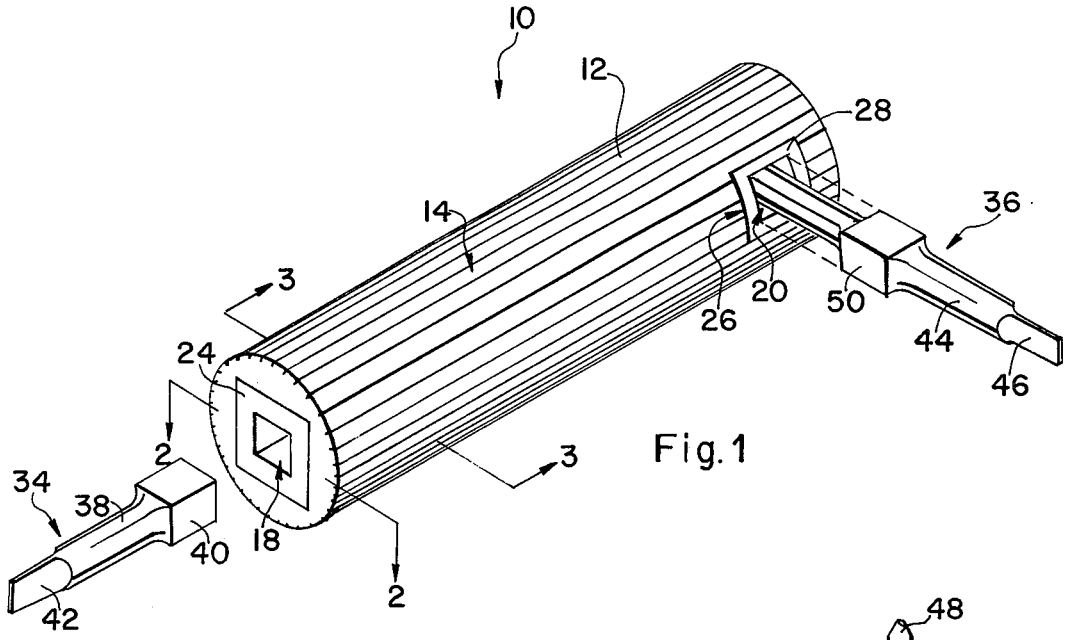
FIG. 1 is a perspective view of a hand-held fastening tool with a pair of fastening elements associated therewith, such tool embodying the features of the invention.

Referring to the left hand side of FIGS. 1 and 2 it will be seen that driver-fastener 34 comprises an axially extending shank 38 having a tang 40 at one end thereof configured and dimensioned so as to be complementary to socket 18. Thus, driver-fastener 34 may be held non-rotatably and releasably retained within such socket by means of the cooperation between the tang and the insert of the socket. A blade-type fastening element 42 is provided at the other end of the driver-fastener. Such fastening element, as seen in FIGS. 1 and 2, may be a screw-driver blade of the type adapted to mate with a similarly slotted screw head. However, it will be understood that the fastening element may, if so desired, comprise a different type of screw-driver blade such as a Phillips head, Phelps head or it may comprise a socket or box wrench or the like.

A second driver-fastener member 36 is shown at the right hand side of FIGS. 1 and 2. It is comprised of an axially extending shank 44 and fastening elements 46, 48 disposed respectively at the opposed ends of the shank. Such fastening elements may consist of a pair of screw-driver blades or of a pair of sockets or box wrenches of a combination of a screwdriver blade and socket or box wrench. As described in connection with driver-fastener 34, where a pair of screw-driver blades are employed it is preferred that they each be adapted to cooperate with a different type of screw head. Intermediate the ends of driver-fastener 36 there is formed a tang 50 which is configured and dimensioned to be complementary to socket 20 and the insert thereof. Thus, as with driver-fastener 34, tang 50 secures driver-fastener 36 non-rotatably and releasably with socket 20.

As can be seen most clearly from FIG. 2, the portions of the shank on both sides of the tang 50 are axially elongated. Desirably at least one of such portions is of a lateral dimension such that it can project through opening 16 of the handle so as to assure the interchangeability of driver-fastener 36 with both of sockets 18, 20. Naturally, to allow for such interchangeability the tang 50 must also be configured and dimensioned to fit non-rotatably and releasably within the recess of socket 18. At least one of such axially extending portions of shank 44, and desirably both of such portions, are of sufficient length and lateral dimension to fit within transverse aperture 30 in the handle and to have the fastening element at the end thereof to project outwardly of the aperture for operative use.

It will be appreciated that whereas the materials from which the handle, the driver-fasteners and the socket inserts are formed are not critical there are certain preferred materials. Thus, the handle may be molded of a synthetic plastics material, and when made of an elastomeric material the non-slide gripping of the handle is enhanced. The material from which the socket inserts are formed is preferably a metal which will neither distort nor loosen under the forces developed when torque is applied to the driver-fastener by virtue of the leverage at the other end of the tool. A chrome-vanadium steel is believed imminently suitable for such inserts. The driver-fasteners may be made of the conventional steels and alloys employed for such driver-fasteners. Certain other alloys may also be utilized as is well known.

From the foregoing it will be seen that a hand-grippable tool has been provided which is more versatile than tools of the same character previously available. Yet the construction is simple so as not to result in greatly increased manufacturing costs.

I claim:

1. A hand-held fastening tool comprising in combination:

an axially elongated handle;

a first socket formed in an end of said handle adapted to receive and non-rotatably retain a first fastener therein;

a second socket formed in a side wall of the handle adjacent the other end thereof and extending transversely thereinto adapted to receive and non-rotatably retain a second fastener therein;

an aperture of lesser lateral dimension than said second socket formed in said handle adjacent said other end extending transversely thereinto and openly communicating with said second socket;

a first driver-fastener comprising an axially extending shank having a tang at one end thereof dimensioned to fit non-rotatably and be releasably retained within said first socket and a fastening element at the other end thereof;

and a second driver-fastener comprising an axially extending shank having first and second blade-type fastening elements at the opposed ends thereof and a tang formed at an intermediate location, said tang being dimensioned to fit non-rotatably and be releasably retained within said second socket, the portion of said shank extending from said tang to one of said first and second fastening elements being dimensioned in length and in width to extend through said transverse aperture in said handle such that said one fastening element projects outwardly of said aperture for operative use.

2. A hand-held tool according to claim 1, wherein said first and second sockets are provided with opposed flat fastener engaging surfaces.

3. A hand-held tool according to claim 2, wherein said sockets are given a square configuration.

4. A hand-held tool according to claim 1, wherein each of said sockets is provided with a metal insert seat adapted to engage with the surfaces of the fastener inserted into said socket.

5. A hand-held tool according to claim 1, wherein said first and second blade-type fastening elements are of different types so as to be operable with fastening means having different type heads.

6. A hand-held tool according to claim 1, wherein said first and second driver-fasteners are adapted to be interchanged so as to fit selectively within either of said first and second sockets.

* * * * *